United States Patent [19]

Alston

[11] 4,182,266

[45] Jan. 8, 1980

[54] MEANS FOR THE PRODUCTION OF LITHOGRAPHIC PRINTING PLATES

[75] Inventor: Julia M. Alston, Myrtle Bank, Australia

[73] Assignee: Research Laboratories of Australia Pty. Limited, Australia

[21] Appl. No.: 799,512

[22] Filed: May 23, 1977

[30] Foreign Application Priority Data

Jul. 21, 1976 [AU] Australia ..... PC6708

[51] Int. Cl.[2] ..... G03G 13/16

[52] U.S. Cl. ..... 118/621; 118/651; 355/3 TR; 430/49; 430/126

[58] Field of Search ..... 118/621, 624, 651; 96/1 TE, 1.4; 101/DIG. 13; 355/3 TE, 3 TR, 11; 427/22, 24

[56] References Cited

U.S. PATENT DOCUMENTS

| | | | |
|---|---|---|---|
| 2,972,304 | 2/1961 | Jarvis | 96/1.4 X |
| 3,083,684 | 4/1963 | Carlson | 101/DIG. 13 |
| 3,551,146 | 12/1970 | Gundlach | 355/3 TE |
| 3,630,591 | 12/1971 | Eastman | 355/3 TR |
| 3,653,890 | 4/1972 | Seimiya et al. | 96/1 TE |
| 3,653,891 | 4/1972 | Thourson et al. | 96/1 TE |
| 3,703,376 | 11/1972 | Gundlach et al. | 118/651 |
| 3,862,848 | 1/1975 | Marley | 96/1.4 X |

*Primary Examiner*—Mervin Stein

*Attorney, Agent, or Firm*—Kinzer, Plyer, Dorn & McEachran

[57] ABSTRACT

A system for producing lithographic printing plates by image transfer from either a right way or a wrong way reading recording member, which comprise a conductive base having first and second register means thereon the register means being arranged and positioned respectively so that the first engages and locates an image receiving member and a recording member on the base and the second engages and locates an offset member on the base, the register means being spaced apart to allow access to the first register means while the offset member is engaged on the second register means, a roller having at least a conductive core arranged to move over the base outwards from the register means and return, and means to apply an electrical field between the roller and base and to change the polarity to prevent electrostatic image transfer during the outward movement of the roller and to cause electrostatic image transfer during the return movement of the roller.

7 Claims, 9 Drawing Figures

MEANS FOR THE PRODUCTION OF LITHOGRAPHIC PRINTING PLATES

BACKGROUND OF THE INVENTION

In the well known art of lithography a printing master or plate is employed having a printing surface on which the printing image areas are ink receptive whereas the non-printing background areas are water receptive. In the process of printing, an aqueous based so-called fountain solution is applied to the printing surface of the plate and such fountain solution adheres to the water receptive background areas only. An oil base ink is then applied to the printing surface of the plate. Such ink is repelled from the fountain solution containing background areas and adheres to the oil receptive printing image areas only. The printing plate is then brought into contact with paper on to which the image is printed by ink transfer from the printing image areas, as known in so-called direct lithography, or alternatively, as known in so-called offset lithography the printing plate is brought into contact with a rubber blanket on to which the image is offset by ink transfer from the printing image areas and in turn such rubber blanket is brought into contact with paper on to which the image is finally printed by ink transfer from the rubber blanket. The above described steps of applying the fountain solution and ink to the plate are repeated preparatory to each paper copy printing.

Lithographic printing plates can be prepared by numerous methods well known in the art, and one such method is electrostatic or electrophotographic imaging.

Typically in one electrostatic imaging process a lithographic printing plate is prepared by employing a conventional electrophotographic member for the formation thereon of a latent electrostatic image pattern by methods well known in the art and developing such image pattern by attraction thereto of electroscopic marking particles, followed by electrostatically transferring the thus formed image deposit on to a water receptive lithographic substrate or plate such as treated paper or grained aluminum and the like on which the transferred image deposit subsequently is fixed or fused and forms the ink receptive printing areas on the water receptive surface of the plate. The aforementioned electrophotographic member may comprise a selenium plate or a so-called binder plate consisting of a paper sheet having on one side thereof a coating of photoconductive zinc oxide contained within an insulating resinous binder material, as is well known in the art, or other inorganic or organic photoconductive layer disposed on a suitable backing or support material. The aforementioned electroscopic marking particles may comprise dry powder toners or so called liquid toners consisting of electroscopic particles dispersed in an insulating carrier liquid, as again is well known in the art.

A lithographic printing plate for off-set lithography is right way reading whereas for direct lithography the plate is wrong way reading. Thus to produce by electrostatic image transfer a right way reading lithographic plate for off-set lithography from an electrophotographic member such as a binder plate it is necessary to produce the image deposit on the binder plate either in wrong way reading sense and then transfer same directly on to the lithographic plate or to produce the image deposit on the binder plate in right way reading sense, then to transfer same on to an intermediate or off-set member and therefrom to transfer same to the lithographic plate.

In the instances where the image on the photoconductive member such as the binder plate is produced by exposure in contact with a transparency such as a film positive or negative it is necessary to have the silver halide emulsion side of the transparency in contact with the electrostatically charged surface of the binder plate in order that no loss in resolution occurs. Thus to obtain a right way reading image on the binder plate the transparency needs to be right way reading emulsion side down whereas for a wrong way reading image on the binder plate the transparency needs to be wrong way reading emulsion side down.

Conventional non-electrostatic lithographic plate making processes generally require the transparency to be right way reading emulsion side down for off-set lithography and wrong way reading emulsion side down for direct lithography. Thus positive and negative film transparencies are made emulsion side down in right or wrong way reading sense depending on their final purpose, and accordingly there is need for a method of and means for employing film transparencies regardless of the sense in which they are produced for the preparation by electrostatic image transfer as described in the foregoing of lithographic printing plates in right or wrong way reading sense, as may be desired.

It will be realised that if irrespective of the sense in which it is prepared a transparency is contact exposed emulsion side down with an electrophotographic member, the image deposit formed on such member can produce by electrostatic transfer a lithographic printing plate in any desired sense depending whether the electrostatic transfer of such image deposit is carried out directly or by offset means. Accordingly there is need for a method of effecting by one and the same means optionallly, as may be desired from case to case, direct or offset electrostatic transfer of image deposit from an electrophotographic member on to a lithographic plate.

Electrostatic direct transfer methods are known and electrostatic offset transfer methods are also known. In U.S. Pat. No. 3,862,848 there is disclosed a method of electrostatic offset transfer of colour images, however the means described in this patent require both the electrophotographic or dielectric member and the image receiving member to be flexible and are thus not applicable to the production of lithographic printing plates in those instances in which the printing plate is a relatively rigid metal sheet.

It is therefore the general object of this invention to provide a novel method of and means for effecting by one and the same means optionally direct or offset electrostatic transfer of image deposit from an electrophotographic or dielectric member on to a rigid or flexible transfer receiving member.

Another object of this invention is to provide a novel method of and means for effecting by one and the same means optionally direct or offset electrostatic transfer of image deposit from an electrophotographic or dielectric member onto lithographic printing plate material.

The foregoing objects and other advantages are accomplished in accordance with this invention in the manner as described in the following.

SUMMARY OF THE INVENTION

The present invention discloses a method of and means for effecting electrostatic transfer of image deposits to a flexible or rigid transfer receiving member such as a metal lithographic printing plate. Transfer is effected directly or by offset as may be desired from case to case and one and the same equipment is employed for each mode of transfer.

In each mode of transfer the transfer receiving member is positioned in register on a rigid flat base member.

In the direct mode, the toned or image deposit containing electrophotographic member, hereinafter called the recording member, is contacted in register with the transfer receiving member in such manner that the image deposit bearing surface of the recording member is next to the transfer receiving member and the image deposit is electrostatically transferred.

In the offset mode, the recording member is contacted in register with the transfer receiving member in such manner that the image deposit bearing surface of the recording member is remote from the transfer receiving member. An intermediate or offset member in register with the transfer receiving and recording members and also in register with ancillary registration means is then contacted with the image deposit bearing surface of the recording member and the image deposit is electrostatically transferred on to the offset member. Following this the offset member is separated but retained in ancillary registration while the recording member is removed. The offset member is then replaced but now in contact with the transfer receiving member and the image deposit is electrostatically transferred from the offset member to the transfer receiving member.

Means are also provided to set or fix the image on the transfer receiving member prior to removing same from the base member.

BRIEF DESCRIPTION OF THE DRAWINGS

In the following detailed description of the invention reference is made to the accompanying drawings wherein.

DESCRIPTION OF THE PREFERRED EMBODIMENTS

Figure 1:
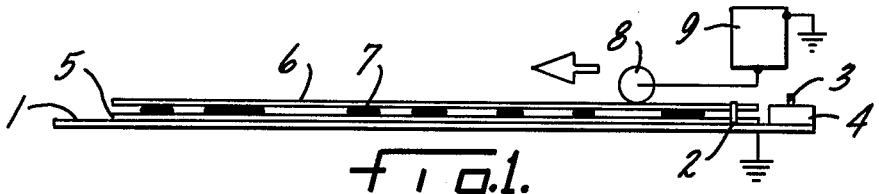
FIGS. 1 and 2 illustrate the process steps and means of the present invention in relation to direct electrostatic transfer of image deposit from a recording member to a transfer receiving member.

Referring to the drawings in detail, FIG. 1 shows a rigid conductive base member 1 containing at one end thereof register pin set 2 and ancillary register pin set 3. Ancillary register pin set 3 is preferably mounted on spacer 4, the height of spacer 4 being about equal to the total thickness of the recording member and the transfer receiving member. Ancillary register pin set 3 and spacer 4 are not used in the direct transfer mode. Transfer receiving member 5 is positioned on rigid conductive base member 1 and located thereon by register pin set 2. Recording member 6 containing developed image deposit 7 on one side thereof is positioned in face contact with transfer receiving member 5 and located thereon by register pin set 2. Image deposit 7 is contained on the side of recording member 6 which contacts transfer receiving member 5. Rotatably mounted roller 8 which may be of metal or may comprise a metallic core covered with a relatively resillient material for good contact is driven by means not shown to traverse in the direction shown preparatory to transfer to cause controlled contact between recording member 6 and transfer receiving member 5. Roller 8 is connected to one high voltage terminal of DC power supply 9, the other high voltage terminal of DC power supply 9 being connected to rigid conductive base member 1 and grounded. DC power supply 9 is energized to produce a directional electrostatic field between roller 8 and rigid conductive base member 1, the direction of said electrostatic field being such that electrostatic transfer of image deposit 7 from recording member 6 to transfer receiving member 5 does not occur in this instance.

Figure 2:
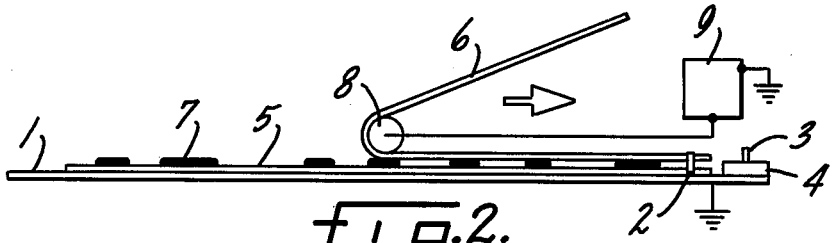

In FIG. 2 is shown the actual transfer operation. Recording member 6 is shown being removed from transfer receiving member 5 by being held in contact with roller 8 which moves in the direction shown. Roller 8 is connected to one high voltage terminal of DC power supply 9, the other high voltage terminal of which is connected to rigid conductive base member 1 and grounded. DC power supply 9 is energized whereby a directional electrostatic field is formed between roller 8 and rigid conductive base member 1, such field being of a direction causing electrostatic transfer of image deposit 7 from the surface or recording member 6 directly to the surface of transfer receiving member 5.

Figure 3:
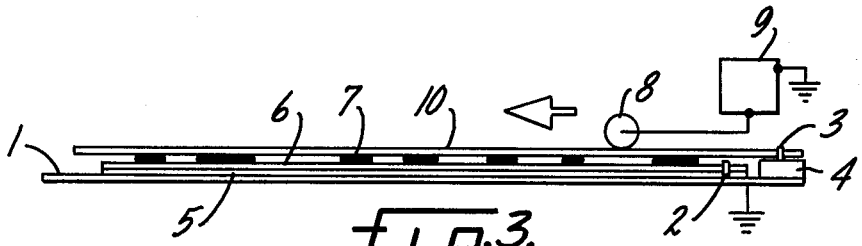
FIGS. 3 to 7 illustrate the process steps and means of the present invention in relation to offset electrostatic transfer of image deposit from a recording member to a transfer receiving member.

The following refers to the offset mode of transfer. In FIG. 3 transfer receiving member 5 is positioned on base member 1 and located thereon by register pin set 2. Recording member 6 having image deposit 7 on one side thereof is positioned above transfer receiving member 5 and located thereon by register pin set 2. Recording member 6 is positioned so that image deposit 7 is on its upper side that is the side not in contact with transfer receiving member 5. Offset member 10 located on ancillary register pins 3 is positioned in face contact with recording member 6 and contacts image deposit 7 thereon. Roller 8 is driven by means not shown to move in the direction shown preparatory to transfer, thereby rolling offset member 10 into controlled contact with recording member 6 and simultaneously rolling recording member 6 into controlled contact with transfer receiving member 5. Roller 8 is connected to one high voltage terminal of DC power supply 9. The other high voltage terminal of DC power supply 9 is connected to rigid conductive base member 1 and grounded. During the passage of roller 8 in the direction shown DC power supply 9 is energised to produce a directional electrostatic field between roller 8 and rigid conductive base member 1 which field is in a direction selected to prevent in this instance transfer of image deposit 7 to offset member 10.

Figure 4:
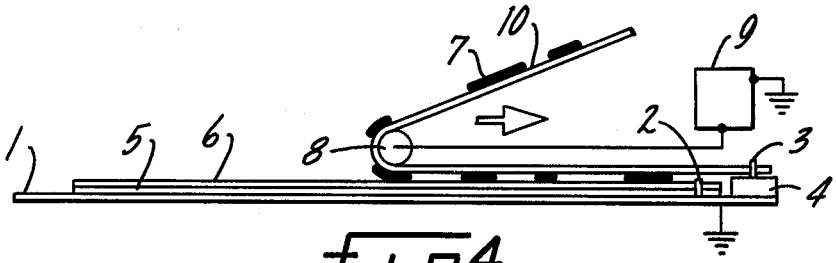

In FIG. 4 is illustrated the offset transfer operation. Offset member 10 is shown being removed from recording member 6 by being held in contact with roller 8 as it moves in the direction shown. During such passage of roller 8 DC power supply 9 is energised to produce a directional electrostatic field between roller 8 and rigid conductive base member 1, such electrostatic field being of a direction causing transfer of image deposit 7 from recording member 6 to offset member 10.

Figure 5:
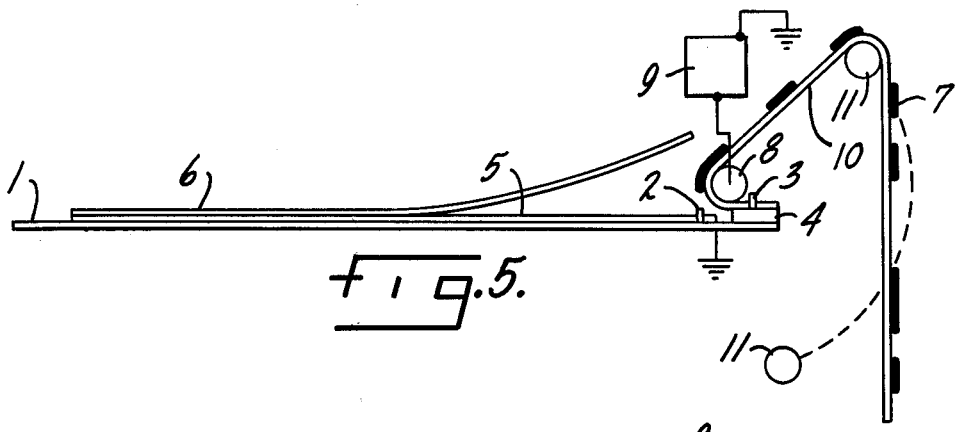

Referring now to FIG. 5, after transfer of image deposit 7 on to offset member 10, DC power supply 9 is not energised and roller 8 is shown in a rest position where it clears register pin set 2 while holding down offset member 10 which remains in register on ancillary pin set 3. Offset member 10 is supported by holding member 11 in such manner that while offset member 10 remains in register on ancillary pin set 3 it clears pin set 2 which holds transfer receiving member 5 and recording member 6 in register. This permits recording member 6 to be firstly lifted off or otherwise disengaged from register pin set 2 and then being lifted off as shown from transfer receiving member 5 which remains in register on pin set 2. Recording member 6 is subsequently discarded. Holding member 11 if so desired can be pivotally mounted and for operator's convenience when not specifically used to support offset member 10 rotated to a lower position as shown with dotted lines in FIG. 5.

Figure 6:
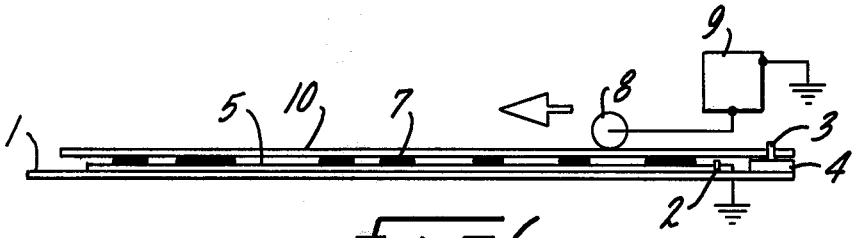

In FIG. 6 will be seen offset member 10 having image deposit 7 on its lower surface placed in contact with transfer receiving member 5. Offset member 10 is registered by ancillary pin set 3 whereas transfer receiving member 5 is registered by pin set 2. Roller 8 moves in the direction shown preparatory to transfer, thereby rolling offset member 10 into controlled contact with transfer receiving member 5. DC power supply 9 is energised to produce a directional electrostatic field between roller 8 and rigid conductive base member 1, which field is in such direction that in this instance transfer of image deposit 7 to transfer receiving member 5 does not occur.

Figure 7:
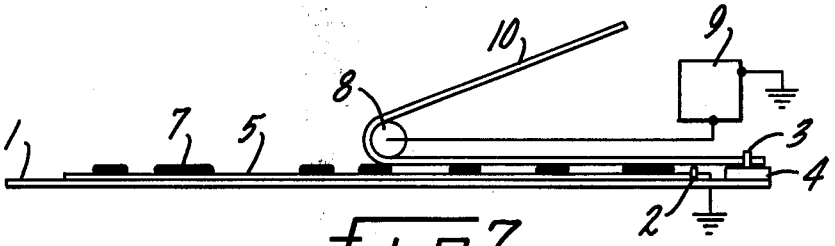

In FIG. 7 is shown the final transfer operation. Offset member 10 is shown being removed from transfer receiving member 5 by being held in contact with roller 8 which moves in the direction shown. DC power supply 9 is energised whereby a directional electrostatic field is formed between roller 8 and rigid conductive base member 1, which field is in such direction that it causes transfer of image deposit 7 from offset member 10 on to the surface of transfer receiving member 5.

Figure 8:
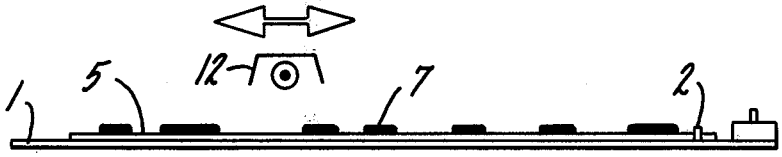
FIG. 8 illustrates a preferred method of setting or fixing the transferred image deposit on the surface of the transfer receiving member.

FIG. 8 illustrates one method of fusing or fixing image deposits on the transfer receiving member surface after image transfer thereto by either the direct or offset methods, without the need to handle or to displace the transfer receiving member. Transfer receiving member 5 containing image deposit 7 on its upper surface is positioned on rigid conductive base member 1 and located thereon by register pin set 2. Heating element 12 is mounted by means not shown to traverse across rigid conductive base member 1 which is normally traversed once in each direction as shown. On the first traverse image deposit 7 is prefused or set to a sufficient extent to allow handling such as that required for correction purposes, and depending on the composition of image deposit 7 the second traverse of heating element 12 may fuse image deposit 7 to firmly adhere to transfer receiving member 5. Further fusing, such as for instance oven fusing, may also be advantageous, particularly for the production of long run printing plates.

Figure 9:
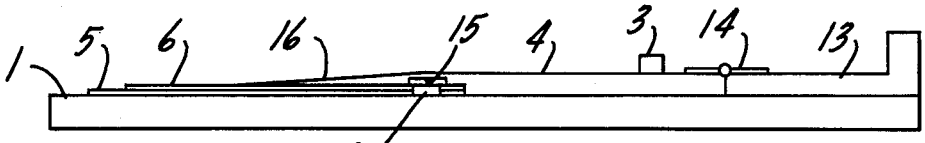
FIG. 9 illustrates a preferred configuration of register means and ancillary register means in accordance with this invention.

FIG. 9 represents a preferred configuration of spacer 4 containing ancillary register pin set 3. Rigid conductive base member 1 contains at one end thereof fixed support member 13. Spacer 4 in this instance is substantially higher than register pin set 2, and is hinged to fixed support member 13 by hinge 14. Spacer 4 extends in the direction away from hinge 14 to cover register pin set 2 and portion of the edge of transfer receiving member 5 and recording member 6. Groove 15 in the underside of spacer 4 is of sufficient depth to prevent the lower side of spacer 4 from contacting register pin set 2. The edge of spacer 4 remote from hinge 14 is tapered at 16 to allow a smooth transition between the upper surface of spacer 4 and recording member 6. The edge of tapered section 16 may be used as a tear edge if desired to allow removal of recording member 6 without dislodging spacer 4 and ancillary register pin set 3.

It will be realized that other methods may be used to provide the smooth transition achieved by the configuration of FIG. 9. For instance register pin set 2 may be retractably mounted to allow smooth traversing of rotatably mounted roller 8 over the area occupied by register pin set 2.

It will be thus seen that the present invention discloses a double registration system whereby lithographic printing plates may be prepared to be correct way reading by direct or offset electrostatic transfer of image deposits from a recording member on to a lithographic plate material. In those instances in which offset transfer is necessary to obtain a correct reading image deposit on the lithographic plate an intermediate offset member is used. The offset member is separately registered by ancillary means to the machine base in such a manner that it may be laid aside to allow removal of the recording member without losing registration between the offset member and the transfer receiving member that is to say the lithographic plate material. The means disclosed herein is particularly suited to the production of image deposits on relatively rigid transfer receiving members such as metal plates of the type commonly used in lithographic printing.

It will be realized that the specific configuration described and illustrated in the foregoing is a preferred embodiment only wherein the objects of the present invention can be attained and thus should be construed in illustrative and not in restrictive sense.

I claim:

1. Means for producing lithographic printing plates by image transfer from either a right way reading recording member or a wrong way reading recording member, as by first transferring an image from the recording member to a transfer receiving member and then subsequently transferring the image from the transfer receiving member to an offset member, which means comprise:

(a) a conductive base having register means and ancillary register means thereon, the first said register means being arranged and positioned to engage and locate the image receiving member and the recording member on said base and the said ancillary register means being arranged and positioned to engage and locate the offset member on said base, the first said register means and said ancillary register means being spaced apart to allow access to the first said register means while said offset member is engaged on said ancillary register means, (b) a roller having at least a conductive core arranged to move over said base outwards from said register means and return in the opposite direction toward said register means, (c) means to apply an electrical field between said roller and said base, and (d) means to change the polarity of said electrical field whereby the said field has one polarity in relation to the said roller on its outward movement and an opposite polarity on its return movement, said polarities being selected to prevent electrostatic image transfer while said members are pressed into intimate contact during the outward movement of the said roller and to cause electrostatic image transfer during the return movement of the said roller.

2. Means according to claim 1 wherein the first said register means comprise pins projecting upwardly from the said base inwards from an edge thereof, and the said ancillary register means also comprise pins projecting from the said base but nearer to the said edge whereby independent access to both said register means and said ancillary register means to engage said members thereon is possible.

3. Means according to claim 2 including a spacer on which said ancillary register means pins are mounted, said spacer being supported on said base and having a height substantially equal to the total thickness of the said recording member and the said image receiving member.

4. Means according to claim 2 including a spacer on which said ancillary register means pins are mounted, said spacer being supported on said base and having a height substantially in excess of the height of said first register means and covering said first register means.

5. Means according to claim 4 wherein the said spacer is hinged to a fixed support member on said base.

6. Means according to claim 1 wherein said roller has a rest position in which said roller retains said offset member engaged on said ancillary register means where such rest position is located to allow access to the first said register means.

7. Means according to claim 6 including a support member and wherein said offset member when engaged on said ancillary register means and retained therein by said roller in said rest position may be supported by said support member allowing access to the first said register means.

* * * * *